US011476565B2

(12) United States Patent
Sampo

(10) Patent No.: US 11,476,565 B2
(45) Date of Patent: Oct. 18, 2022

(54) PATCH ANTENNA AND ANTENNA DEVICE FOR VEHICLE

(71) Applicant: YOKOWO CO., LTD., Tokyo (JP)

(72) Inventor: Takeshi Sampo, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/649,137

(22) PCT Filed: Aug. 1, 2018

(86) PCT No.: PCT/JP2018/028892
§ 371 (c)(1),
(2) Date: Mar. 20, 2020

(87) PCT Pub. No.: WO2019/073667
PCT Pub. Date: Apr. 18, 2019

(65) Prior Publication Data

US 2020/0295444 A1 Sep. 17, 2020

(30) Foreign Application Priority Data

Oct. 13, 2017 (JP) ..... JP2017-199095

(51) Int. Cl.
*H01Q 1/32* (2006.01)
*H01Q 1/48* (2006.01)
*H01Q 9/04* (2006.01)

(52) U.S. Cl.
CPC ..... *H01Q 1/3283* (2013.01); *H01Q 1/48* (2013.01); *H01Q 9/0407* (2013.01)

(58) Field of Classification Search
CPC ..... H01Q 1/32–1/3291; H01Q 1/24–38
See application file for complete search history.

(56) References Cited

U.S. PATENT DOCUMENTS 6,337,661 B1 * 1/2002 Kondoh ..... H01L 23/552 257/E23.114
6,731,243 B2 * 5/2004 Taira ..... H01Q 9/0407 343/700 MS (Continued)

FOREIGN PATENT DOCUMENTS

JP 3-157005 A 7/1991
JP 2002-009537 A 1/2002

(Continued)

OTHER PUBLICATIONS

Extended Search Report dated May 31, 2021, in corresponding European Patent Application No. 18866316.5.

(Continued)

*Primary Examiner* — Hasan Islam
(74) *Attorney, Agent, or Firm* — Xsensus LLP

(57) ABSTRACT

A patch antenna includes a flat-plate radiating element; and a metal wall provided outside a peripheral edge of the radiating element, such that a wall surface of the metal wall intersects a line connecting a center of the radiating element and a feeding point. An antenna device for a vehicle includes: the patch antenna; a housing installed in a predetermined orientation at a predetermined position of the vehicle; and a support supporting the patch antenna such that the patch antenna is used for vertically polarized waves when the housing is installed in the predetermined orientation at the predetermined position.

11 Claims, 13 Drawing Sheets

(56) References Cited

U.S. PATENT DOCUMENTS

| | | | | |
|---|---|---|---|---|
| 6,756,942 | B2 * | 6/2004 | Heyde | H01Q 9/0414 343/700 MS |
| 7,821,460 | B2 | 10/2010 | Schillmeier et al. | |
| 9,270,017 | B2 * | 2/2016 | Villarroel | H01Q 1/3275 |
| 2004/0203390 | A1 | 10/2004 | Inoue | |
| 2005/0146469 | A1 * | 7/2005 | Sampo | H01Q 19/28 343/700 MS |
| 2010/0073236 | A1 | 3/2010 | Mierke et al. | |
| 2017/0352960 | A1 * | 12/2017 | Zhang | H05K 1/0221 |

FOREIGN PATENT DOCUMENTS

| | | | |
|---|---|---|---|
| JP | 2003-347838 | A | 12/2003 |
| JP | 2004-320214 | A | 11/2004 |
| JP | 2012-060486 | A | 3/2012 |
| JP | 2012-070156 | A | 4/2012 |

OTHER PUBLICATIONS

International Search Report and Written Opinion dated Oct. 23, 2018 for PCT/JP2018/028892 filed on Aug. 1, 2018, 9 pages including English Translation of the International Search Report.
Office Action dated Mar. 10, 2022, in corresponding Chinese patent Application No. 201880063746.3, 9 pages.

* cited by examiner

[ SEC. VIII-VIII ]

| ANGLE (deg) | NO METAL MEMBER | EMBODIMENT | ALL-AROUND SUR-ROUNDING LAYOUT (AN EXAMPLE OF MODIFICATIONS) |
|---|---|---|---|
| 90 | -3.65 | -1.51 | -3.63 |
| -90 | -4.56 | -1.96 | -4.42 |

| ANGLE (deg) | NO METAL MEMBER | EMBODIMENT | L-SHAPED LAYOUT (AN EXAMPLE OF MODIFICATIONS) |
|---|---|---|---|
| 90 | -3.65 | -1.734 | -3.379 |
| −90 | -4.56 | -1.734 | -3.662 |

PATCH ANTENNA AND ANTENNA DEVICE FOR VEHICLE

CROSS-REFERENCE TO RELATED APPLICATIONS

The present application is based on PCT filing PCT/JP2018/028892, filed Aug. 1, 2018, which claims priority to JP 2017-199095, filed Oct. 13, 2017, the entire contents of each are incorporated herein by reference.

TECHNICAL FIELD

The present invention relates to a patch antenna and an antenna device for a vehicle.

BACKGROUND ART

A patch antenna is known as a flat antenna having a square or circular radiating element with a small area. The patch antenna has a wide range of uses and Patent Document 1 discloses a patch antenna that can receive circularly polarized satellite-wave signals and linearly polarized ground-wave signals and has a reduced installation height.

PRIOR ART DOCUMENTS

Patent Literature

Patent Literature 1: Japanese Unexamined Patent Application Publication No. 2003-347838

SUMMARY OF INVENTION

Problems to be Solved by the Invention

Conventional patch antennas generally have a configuration made up of a flat-plate radiating element and a flat-plate ground plate placed parallel to the radiating element. Therefore, the antennas have high directivity in a normal direction (in a direction at an angle of elevation of 90 degrees as viewed from the center of the radiating element) to a plate surface of the radiating element. However, regarding directivities in the bearings of plate directions, that are extension directions of the plate surface of the radiating element, i.e., directivities in the bearings of the plate directions of the radiating element, as viewed from the center of the radiating element, where the above mentioned bearings are called azimuth directions or directions of azimuth angle or the like, gain is relatively high in a direction parallel to a line connecting the center of the radiating element and a feeding point, but relatively low in directions intersecting the line connecting the center of the radiating element and the feeding point.

Solution to the Problems

According to a first aspect of the present invention, there is provided a patch antenna including: a flat-plate radiating element; and a metal wall provided outside a peripheral edge of the radiating element, such that a wall surface of the metal wall intersects a line connecting a center of the radiating element and a feeding point.

According to the first aspect, the metal wall is provided outside the peripheral edge of the radiating element such that the wall surface of the metal wall intersects a line connecting the center of the radiating element and the feeding point. The metal wall can vary radiation characteristics of radio waves. Therefore, it possible to implement a technique for improving gain in directions intersecting the line connecting the center of the radiating element and the feeding point out of plate directions of the radiating element.

According to a second aspect of the present invention, in the patch antenna according to the first aspect, the metal wall protrudes forward of the radiating element in a radiation direction.

According to the second aspect, since the metal wall protrudes forward of the radiating element in the radiation direction, the radiation characteristics can be varied greatly.

According to a third aspect of the present invention, in the patch antenna according to the first or second aspect, the metal wall is installed by being electrically isolated from a ground plate.

According to the third aspect, the metal wall is electrically isolated from the ground plate. Therefore, it possible to reduce or inhibit interaction between the metal wall and the ground plate functioning as a ground.

According to a fourth aspect of the invention, the patch antenna according to the third aspect further includes: a metal part composed of a base and the metal wall formed by a bent-shaped metal; and an antenna main body having the radiating element and the ground plate, where the ground plate is installed by being spaced away from the base and thereby electrically isolated from the metal part.

According to a fifth aspect of the present invention, in the patch antenna according to the fourth aspect, the metal wall is placed on either side of the radiating element; and the metal part has a bent shape formed by the base located in a central portion and the metal walls located on one side and the other side, respectively.

According to the fourth or fifth aspect, since the metal wall can be formed by the bent-shaped metal, the metal wall can be produced easily. Also, the metal part and antenna main body can be arranged in a relatively simple configuration. Therefore, it possible to easily produce a patch antenna that achieves working effects of the first to third aspects.

According to a sixth aspect of the present invention, in the patch antenna according to any one of the first to fifth aspects, the metal wall is configured as a thin metal film.

According to the sixth aspect, the thickness of the metal wall can be reduced. Therefore, it possible to downsize the patch antenna.

According to a seventh aspect of the present invention, there is provided an antenna device for a vehicle, the antenna device being equipped with the patch antenna according to any one of the first to sixth aspects, the antenna device including: a housing installed in a predetermined orientation at a predetermined position of the vehicle; and a support supporting the patch antenna such that the patch antenna is used for vertically polarized waves.

According to the seventh aspect, it is possible to implement a vertically polarized antenna device for a vehicle with improved gain in directions intersecting the line connecting the center of the radiating element and the feeding point out of plate directions of the radiating element.

DESCRIPTION OF EMBODIMENTS

Figure 1:
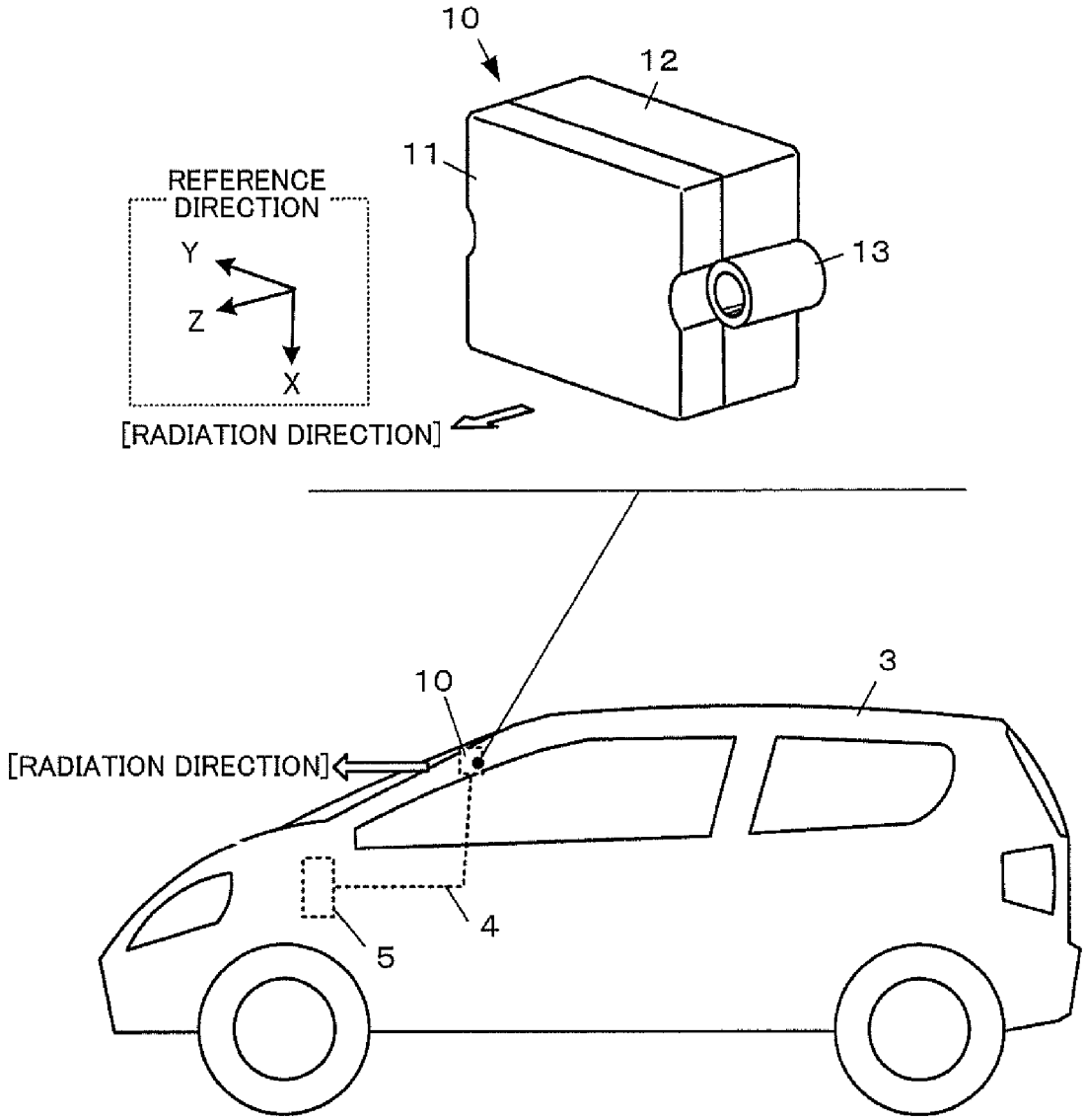
FIG. 1 is an external perspective view illustrating a configuration example of an antenna device for a vehicle and a conceptual diagram illustrating an application example.

An example of embodiments to which the present invention is applied will be described below, but the configurations to which the present invention is applicable are not limited to the embodiment described below.

In the present embodiment, directions are defined as follows. First, in a patch antenna 20 structured such that a radiating element 31 and a ground plate 33 (also referred to as a ground conductor plate) are stacked on opposite sides of a dielectric substrate 32 (see FIG. 3), the direction from the dielectric substrate 32 to the radiating element 31 is referred to as a "radiation direction." The radiation direction has a fixed orientation rather than including both the direction from the dielectric substrate 32 to the radiating element 31 and the direction from the radiating element 31 to the dielectric substrate 32. Also, three orthogonal axes in a left-handed system are defined. A coordinate origin of the three orthogonal axes is set at the plate center of the radiating element 31. To make it easy to see the directions of the three orthogonal axes, reference directions parallel to the directions of the three orthogonal axes are added in each drawing. The term "reference directions" is used here because, correctly speaking, the origin of the three orthogonal axes is the plate center of the radiating element 31. The reference directions are shown for reference purposes only.

In the three orthogonal axes in the left-handed system, the normal direction to the plate surface of the radiating element 31 is defined as a Z-axis direction and the orientation of the radiation direction is defined as a Z-axis positive direction. Also, the direction along a line connecting the center of the radiating element 31 and a feeding point (also referred to as a core wire attachment hole) 31*h* is defined as an X-axis direction (see FIG. 2) and the direction from the center of the radiating element 31 to the feeding point 31*h* is defined as an X-axis positive direction. The Y-axis direction and Y-axis positive direction are self-evident because it is known that the three orthogonal axes in the left-handed system are used and because the X-axis positive direction and Z-axis positive direction have been defined.

If the directions are defined in other words, as viewed from the center (origin of the three orthogonal axes) of the radiating element 31, the direction at an angle of elevation of 90 degrees with respect to the directions (plate directions) along the plate surface of the radiating element 31 is the Z-axis positive direction, the direction from the center of the radiating element 31 to the feeding point 31*h* is the X-axis positive direction, and the 3 o'clock direction is Y-axis positive direction when the X-axis positive direction as viewed from the Z-axis positive direction to the Z-axis negative direction is the 12 o'clock direction. The plate directions of the radiating element 31 are also called azimuth directions, directions of azimuth angle, and the like.

The term X-axis direction herein means directions parallel to the X axis and includes both the X-axis positive (+) direction and X-axis negative (−) direction. The same applies to the Y-axis direction and Z-axis direction. Thus, the axis directions correspond to the reference directions shown in each drawing.

Also, in the patch antenna 20, regarding an E plane and H plane that are an electric field plane and magnetic field plane of the radiating element 31, respectively, when viewed from the center (origin of the three orthogonal axes) of the radiating element 31, a plane in X-Z directions including the X-axis direction and Z-axis direction is the E plane while a plane in the Y-Z directions including the Y-axis direction and Z-axis direction are H plane. If the E plane and H plane are defined in other words, a plane including the direction perpendicular to the plate surface of the radiating element 31 and the direction of the line connecting the center of the radiating element 31 and feeding point 31*h* is the E plane while a plane perpendicular to the E plane and including the direction perpendicular to the plate surface of the radiating element 31 is the H plane.

FIG. 1 is an external perspective view illustrating a configuration example of an antenna device 10 for a vehicle according to the present embodiment and a conceptual diagram illustrating an application example.

The antenna device 10 for a vehicle, that is equipped with a vehicle-mount patch antenna for V2X (Vehicle-to-everything) communications, is installed in a predetermined orientation at a predetermined position of a vehicle 3 and connected to a V2X controller 5 via a coaxial cable 4.

The antenna device 10 for a vehicle is installed in an upper part (e.g., near a rearview mirror) of a windshield inside the vehicle in such a way that the radiation direction will face forward of the vehicle, where the term "forward" means a traveling direction of the vehicle.

The installation positions and installed number of the antenna device 10 for a vehicle can be changed as appropriate according to environmental conditions of expected communications targets and the like. The antenna device 10 for a vehicle may be installed, for example, in two or more locations. Examples of possible installation locations include an upper part of a dashboard, a bumper, an attachment part of a number plate mount, and pillars such as A-pillars. The antenna device 10 for a vehicle may be installed on rear glass inside the vehicle in such a way that the radiation direction will face rearward of the vehicle, where the term "rearward" means the direction opposite the traveling direction of the vehicle. Also, the antenna device 10 for a vehicle may be installed in such a way that the radiation direction will face the right or left side of the vehicle, where the term "right side" means the right side with respect to the traveling direction of the vehicle and the term "left side" means the left side with respect to the traveling direction of the vehicle. Also, if the antenna device 10 for a vehicle is structured to ensure performance conditions of water resistance and dust resistance, the antenna device 10 may be installed on a roof or the like of the vehicle.

The antenna device 10 for a vehicle according to the present embodiment has a rectangular external appearance and contains the patch antenna 20 in a case having a block construction divided into a first housing 11 and second housing 12 in the radiation direction. Then, by being mounted on the vehicle 3 via on-vehicle mounting supports 13 provided on side faces of the housing, the patch antenna 20 functions suitably as a vertically polarized antenna. In the present embodiment, the supports 13 are provided as bosses for use to insert bolts or screws for use to install the antenna device 10 for a vehicle, on both left and right side faces (opposite side faces in the Y-axis direction) of the housings as viewed from the vehicle 3, but the setup positions of the supports 13 and the number of supports 13 to be set up may be selected as appropriate. Also, the method for installing and fixing the antenna device 10 for a vehicle is not limited to the one that uses bolts or screws, and another method may be used, and accordingly, a structure such as a clip-on structure suitable for the method may be adopted for the supports 13 as appropriate.

The supports 13 support the first housing 11 and second housing 12 such that the first housing 11 and second housing 12 will be installed in predetermined orientations at predetermined positions of the vehicle 3. That is, when the first housing 11 and second housing 12 are installed in predetermined orientations at predetermined positions of the vehicle 3, the supports 13 support the patch antenna 20 such that the patch antenna 20 will function as a vertically polarized antenna.

Figure 2:
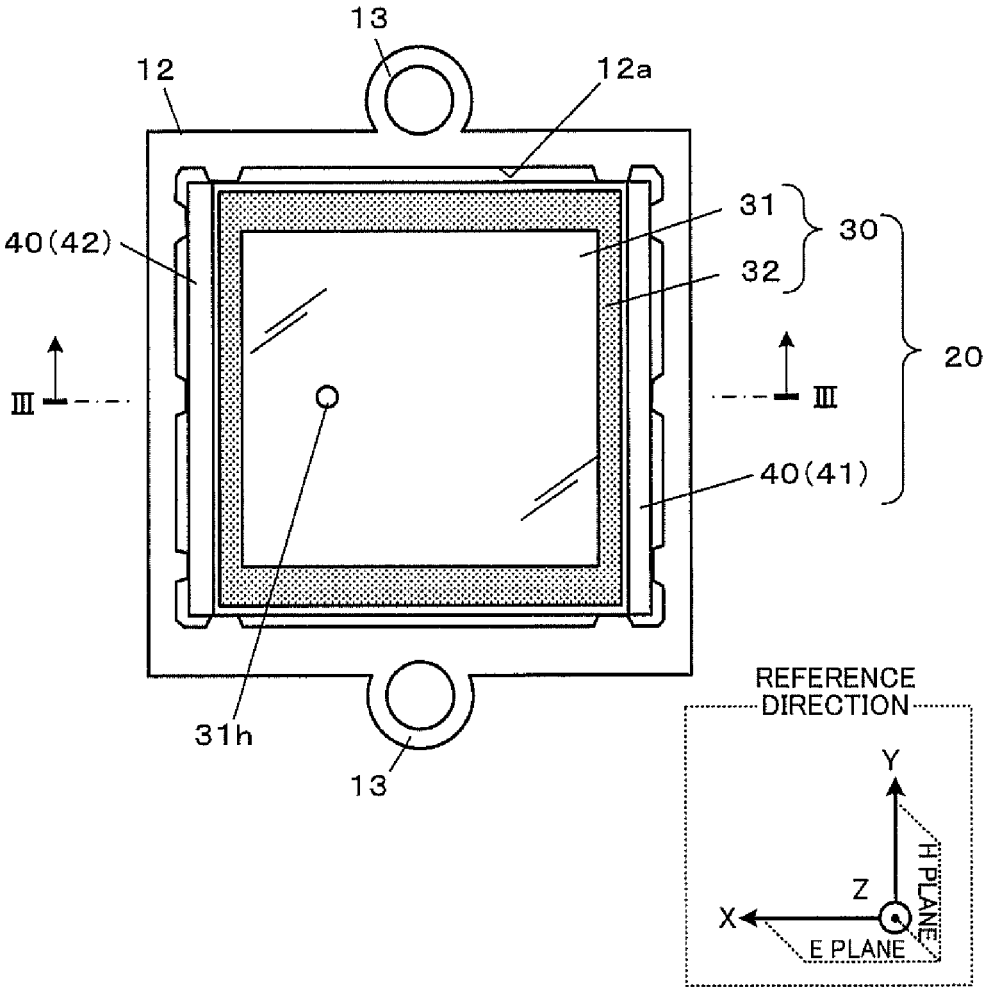
FIG. 2 is a diagram illustrating an internal configuration example of the antenna device for a vehicle.

FIG. 2 is a diagram explaining an internal configuration example of the antenna device 10 for a vehicle, illustrating the inside of the second housing 12 as viewed from the Z-axis positive direction with the first housing 11 removed.

Figure 3:
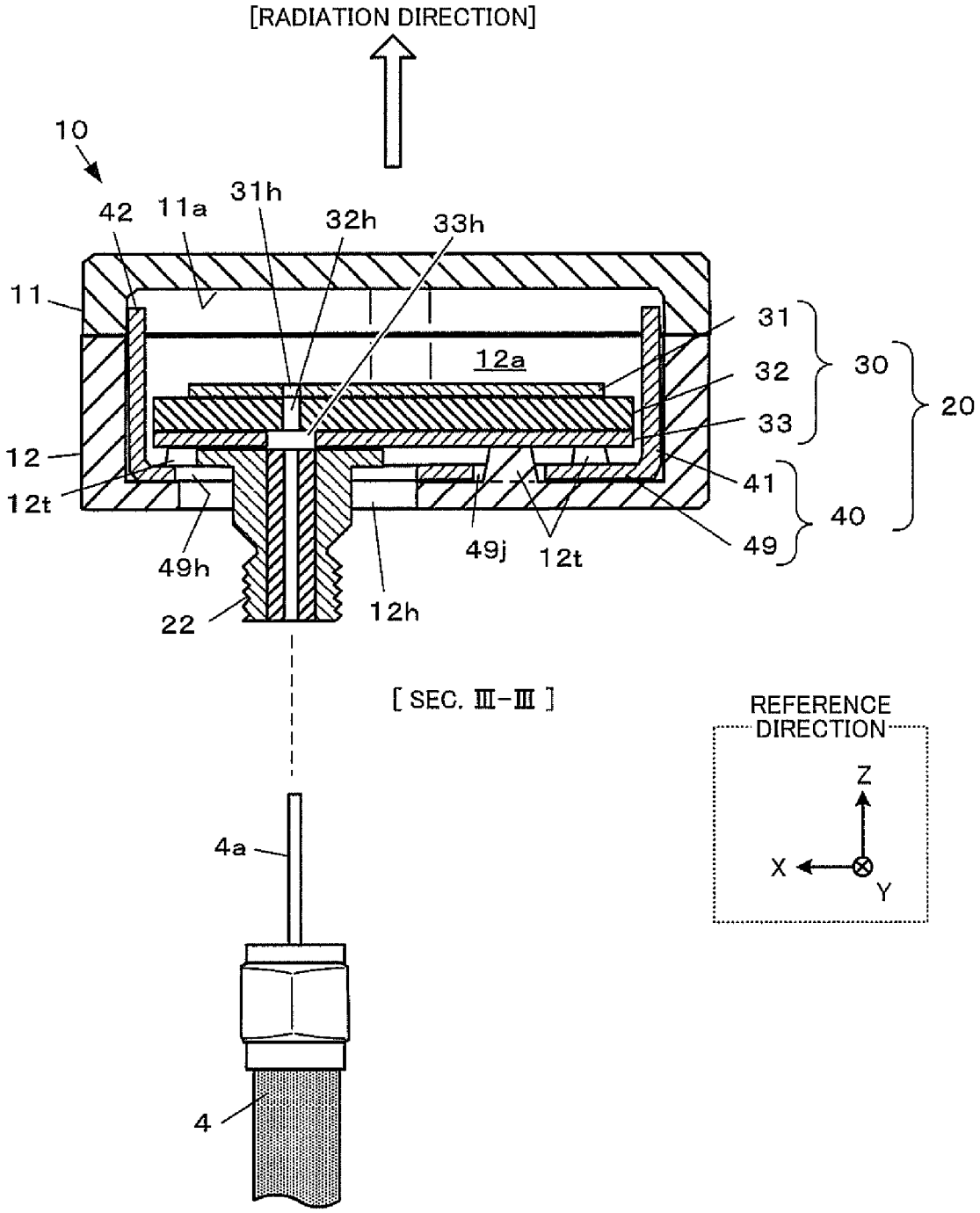
FIG. 3 is a longitudinal sectional view of the antenna device for a vehicle taken along line in FIG. 2.

Similarly, FIG. 3 is a diagram explaining an internal configuration example of the antenna device 10 for a vehicle, and is also a longitudinal sectional view of the antenna device 10 for a vehicle, including the first housing 11, taken along line III-III in FIG. 2.

Figure 4:
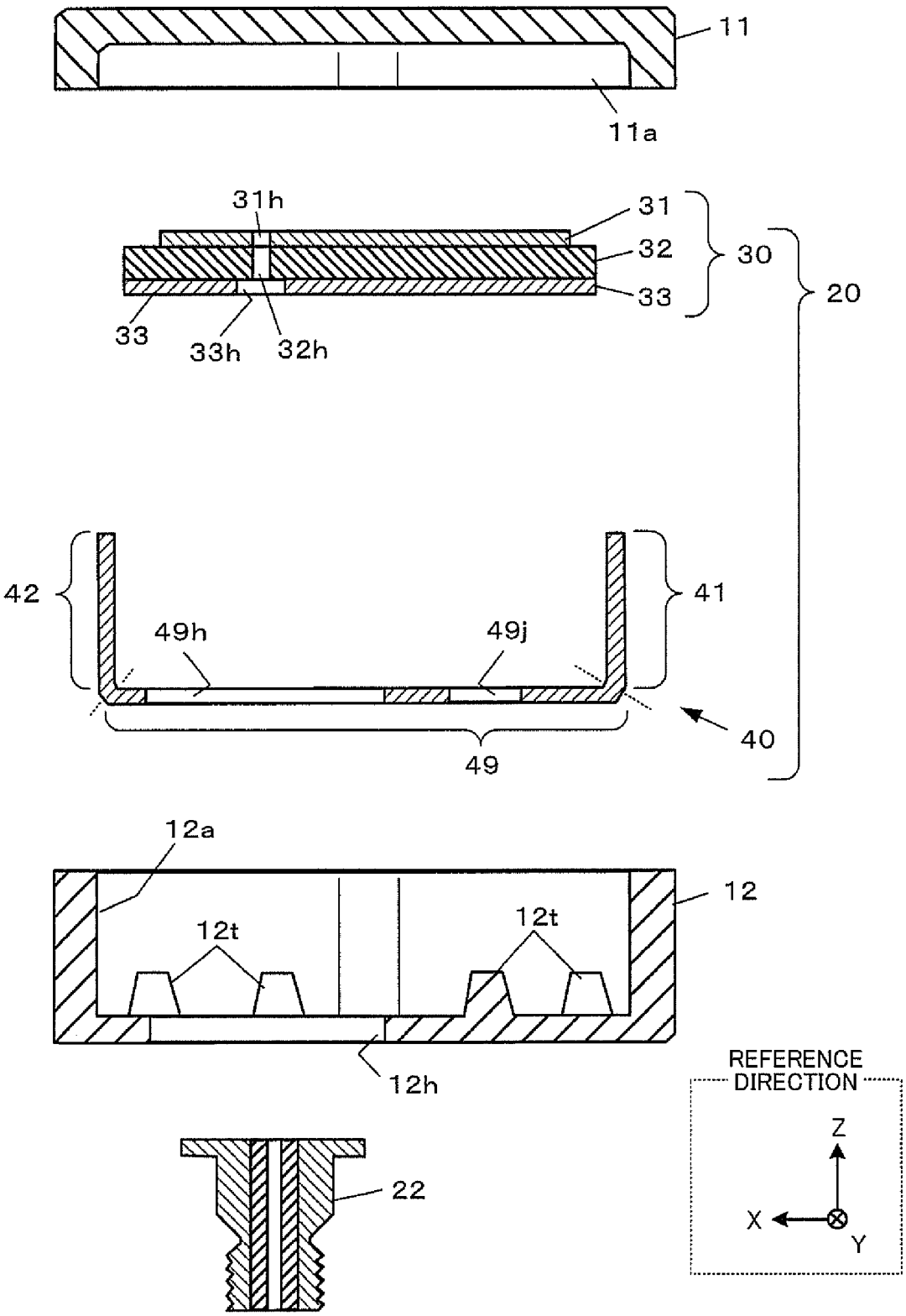
FIG. 4 is an exploded view of the antenna device for a vehicle, corresponding to FIG. 3.

FIG. 4 is an exploded view of the antenna device 10 for a vehicle, including the first housing 11, i.e., an exploded view of the antenna device 10 for a vehicle illustrated in FIG. 3.

As illustrated in FIGS. 3 and 4, the first housing 11 defines an upper accommodation space 11*a* that is a recess, and the second housing 12 defines a lower accommodation space 12*a* that is a recess. The upper accommodation space 11*a* and lower accommodation space 12*a* become a single continuous accommodation space when the first housing 11 and second housing 12 are assembled together. The patch antenna 20 is installed so as to fit in the accommodation space, and mainly in the lower accommodation space 12*a*.

The patch antenna 20 includes an antenna main body 30 and a metal part 40 beginning at the top in FIGS. 3 and 4.

The antenna main body 30 includes the radiating element 31, the dielectric substrate 32, and the ground plate 33 beginning at the top in FIGS. 3 and 4. As with conventional patch antennas, the antenna main body 30 can be created by the application of a manufacturing method for printed circuit boards.

The radiating element 31 has a rectangular plate shape when viewed from the Z-axis positive direction and has a core wire attachment hole 31*h* at a position shifted in the X-axis positive direction (direction along a polarization plane of linearly polarized waves of the patch antenna 20) from the plate center, where the core wire attachment hole 31*h* is a through-hole running in the Z-axis direction for inserting and fixing a core wire 4*a* of the coaxial cable 4. The core wire attachment hole 31*h* serves as a feeding point. Thus, the core wire attachment hole 31*h* will be referred to as the feeding point 31*h* using the same reference sign, as appropriate. In FIGS. 3 and 4, to facilitate understanding of the structure, the radiating element 31 and ground plate 33 are illustrated with intentionally increased thickness in the Z-axis direction, but actually these components may be formed as thin plates, i.e., as thin films.

The dielectric substrate 32 has a wider area than the radiating element 31 when viewed from the Z-axis positive direction. The dielectric substrate 32 has a core wire insertion hole 32*h* that is configured to penetrate the dielectric substrate 32 in the Z-axis direction and positioned in such a way as to be communicated with the core wire attachment hole 31*h* in the radiating element 31.

The ground plate 33 has the same shape as or a slightly smaller shape than an undersurface of the dielectric substrate 32 and has a core wire insertion hole 33*h* that is communicated with the core wire attachment hole 31*h* in the radiating element 31 and the core wire insertion hole 32*h* in the dielectric substrate 32. A coaxial connector 22 for substrate is mounted on an undersurface of the ground plate 33 through an insertion hole 12*h* provided in a bottom portion of the second housing 12 in such a way as to be coaxial with the core wire insertion hole 33*h*. In FIG. 3 and the like, to ensure insulation from the core wire 4*a*, the core wire insertion hole 33*h* is illustrated as being large. However, if an insulation film is applied around the core wire insertion hole 33*h* in the ground plate 33 or insulation is otherwise ensured between the ground plate 33 and core wire 4*a*, the core wire insertion hole 33*h* may be equal in diameter to the core wire attachment hole 31*h* and core wire insertion hole 32*h*.

The metal part 40 is made of sheet metal material with opposite end portions thereof in the X-axis direction being bent in the Z-axis positive direction. Specifically, using a center portion of a metal sheet as a base 49, by bending one side and another side 90 degrees or substantially 90 degrees each in the Z-axis positive direction, the base 49, a first metal wall 41, and a second metal wall 42 are formed by a bent-shaped metal. That is, the first metal wall 41 and second metal wall 42 have their wall surfaces provided in an orientation along the H plane (in an orientation parallel to or substantially parallel to the H plane). In other words, the first metal wall 41 and second metal wall 42 are provided such that their wall surfaces will be orthogonal to a line (X-axis direction) connecting the center of the radiating element 31 and feeding point 31*h*. Rather than being made of sheet metal material, the metal part 40 may be, for example, a thin metal film formed on a resin surface. Also, a thin metal film may be formed on an inner surface of the second housing 12 as the metal part 40 (and maybe on an inner surface of the first housing 11 as well). Accordingly, the antenna device 10 for a vehicle can be downsized since the sheet metal material is not needed. Even in those cases, the base 49, first metal wall 41, and second metal wall 42 are formed of metal into a bent shape. Also, the first metal wall 41 and second metal wall 42 may be formed as thin metal films by omitting the base 49. Furthermore, if only one of the first metal wall 41 and second metal wall 42 is provided, the one to be provided may be formed as a thin metal film.

The first metal wall 41 and second metal wall 42 are flat-plate parts parallel or substantially parallel to each other. Lengths of the first metal wall 41 and second metal wall 42 in the Z-axis direction are set such that respective end portions in the Z-axis positive direction (end portions in FIG. 3) will protrude forward of a top face of the antenna main body 30 (surface of the radiating element 31, i.e., end face in the Z-axis positive direction) in the Z-axis positive direction.

The base 49 is provided with a connector insertion hole 49*h* for inserting the coaxial connector 22 for substrate and a protrusion insertion hole 49*j* for inserting a protrusion 12*t* (see FIG. 4) protruding forward of a bottom face of the lower accommodation space 12*a* of the second housing 12 in the Z-axis positive direction.

During assembly, the metal part 40 is fixed to the bottom portion of the second housing 12 with proper alignment ensured by inserting the protrusion 12*t* of the second housing 12 into the protrusion insertion hole 49*j* of the base 49. Any fixing method can be selected as appropriate, including, for example, a method of bonding together the metal part 40 and the bottom portion of the second housing 12.

The protrusion 12*t* protrudes forward of the base 49 in the Z-axis positive direction and fixed to the antenna main body 30 with a tip of the protrusion 12*t* abutting against an undersurface (surface of the ground plate 33, i.e., end face in the Z-axis negative direction) of the antenna main body 30. Any fixing method can be selected as appropriate, including, for example, a method of bonding together the antenna main body 30 and protrusion 12*t*. In this instance, a suitable gap between a top face (end face in the Z-axis positive direction) of the base 49 and the surface of the ground plate 33 is less than 2 millimeters. Also, when the antenna main body 30 is fixed, a gap is provided such that an outer periphery of the antenna main body 30 will not contact with the metal part 40. That is, the antenna main body 30 and the coaxial substrate connector 22 are installed by being electrically isolated from the metal part 40.

A gap between the antenna main body 30 and metal part 40 including the gap between the top face of the base 49 and the surface of the ground plate 33 functions as a kind of capacitor that does not obstruct propagation (conduction) of radio signals of V2X communications. Therefore, the gap may be either an air layer, i.e., a space, or a resin layer that is an electrically insulative material. When the gap is a resin layer, the resin can also be used both as a space filler and bonding agent.

When the antenna main body 30 and metal part 40 are electrically isolated from each other, various advantages are available. For example, it becomes possible to reduce or inhibit interaction between the ground plate 33 and metal part 40 and thereby limit variations in characteristics and electrical stability when the antenna device 10 for a vehicle is mass-produced. Also, if the antenna main body 30 can be made a common component with that incorporated in other antenna devices, a mass production effect can be enhanced.

Figure 5:
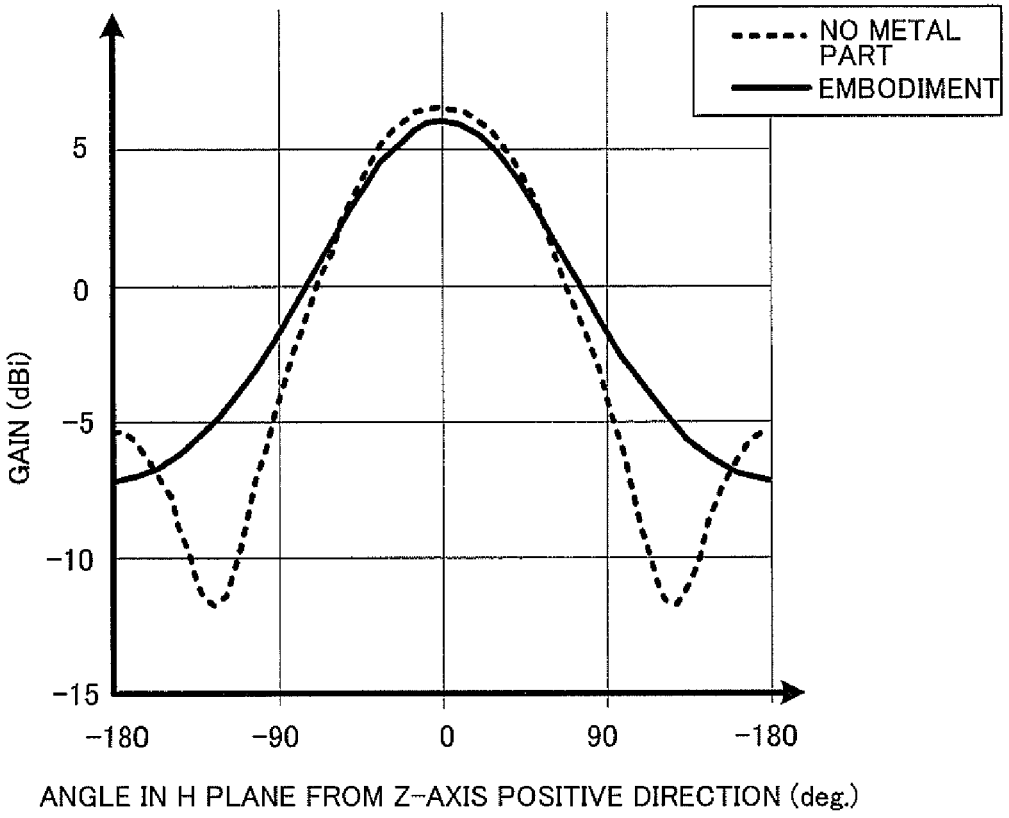
FIG. 5 is a graph of gain characteristics in an H plane (plane in Y-Z directions) of the antenna device for a vehicle.

FIG. 5 is a graph of gain characteristics in the H plane (plane in the Y-Z directions), explaining effects of the antenna device 10 for a vehicle according to the present embodiment. The illustrated antenna gain is obtained when the Z-axis positive direction in the H plane is 0 degrees and the Z-axis negative direction is −180 degrees. Since the +90-degree direction and −90-degree direction correspond to the Y-axis directions, out of the plate directions of the radiating element 31, the +90-degree direction and −90-degree direction are orthogonal to the line connecting the center of the radiating element 31 and feeding point 31*h*. The solid line represents characteristics of the antenna device 10 for a vehicle according to the present embodiment and the dotted line represents characteristics of a comparative configuration (conventional configuration) in which the metal part 40 is omitted.

When attention is focused around directions of ±90 degrees orthogonal to the line connecting the center of the radiating element 31 and feeding point 31*h* out of the plate directions of the radiating element 31, the gain is improved, showing the working effect obtained by providing the first metal wall 41 and second metal wall 42. As a property of the patch antenna 20, electric flux lines are generated between peripheral edges of the radiating element 31 and ground plate 33, and an electric flux line along the E plane is higher in density than an electric flux line along the H plane. That is, of the peripheral edges of the radiating element 31, high-density electric flux lines are generated on a side closer to the first metal wall 41 (right side of the quadrilateral of the radiating element 31 in FIG. 2) and on a side closer to the second metal wall 42 (left side of the quadrilateral of the radiating element 31 in FIG. 2). It is considered that the gain is improved as a result of changing radiation characteristics of the patch antenna 20 since electromagnetic effects are produced between the electric flux lines, and the first metal wall 41 and second metal wall 42.

According to the present embodiment, the first metal wall 41 and second metal wall 42 are provided outside the peripheral edges of the radiating element 31 in such a way that their wall surfaces intersect a line (X-axis direction) connecting the center of the radiating element 31 and feeding point 31*h*. Alternatively, the metal walls may be provided in such a way that their wall surfaces intersect the Y-axis direction. In this case, it possible to improve the gain in the direction of the line connecting the center of the radiating element 31 and feeding point 31*h*.

Figure 6A:
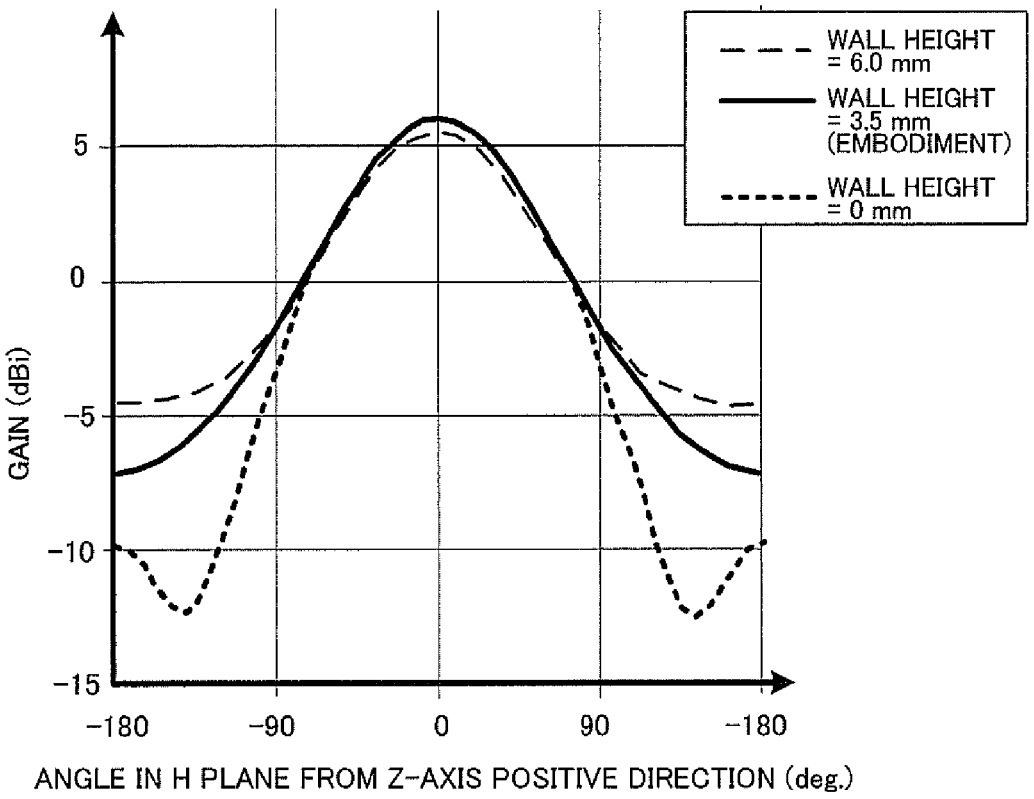
FIG. 6A is a graph of gain characteristics in the H plane (plane in Y-Z directions) when a wall height of metal walls is changed.
Figure 6B:
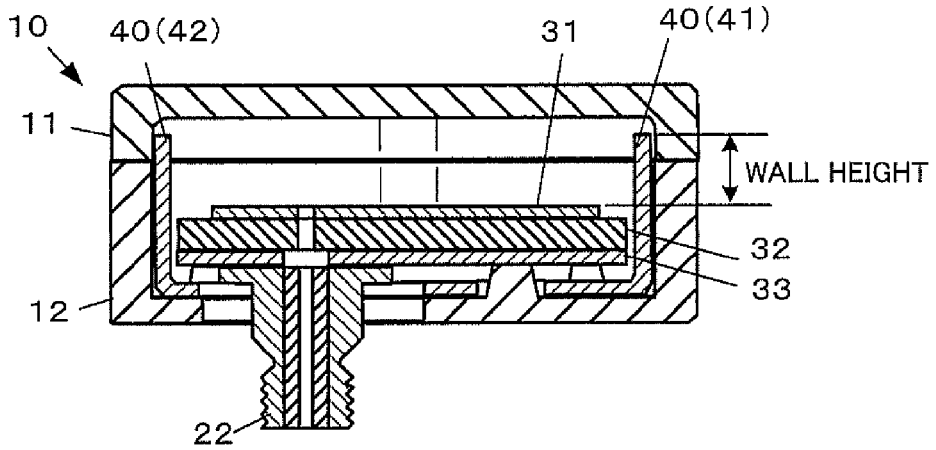
FIG. 6B is a longitudinal sectional view of the antenna device for a vehicle, the sectional view being provided to explain the wall height.

FIG. 6A is a gain characteristic curve in the H plane (plane in Y-Z directions) when wall height (protrusion length from the radiating element 31, i.e., length in the Z-axis direction) of the first metal wall 41 and second metal wall 42 is changed. As with FIG. 5, the illustrated antenna gain is obtained when the Z-axis positive direction in the H plane is 0 degrees and the Z-axis negative direction is −180 degrees. The +90-degree direction and −90-degree direction correspond to the Y-axis directions. In FIG. 6A, the dotted line represents characteristics when the wall height is 0 mm, the solid line represents characteristics when the wall height is 3.5 mm corresponding to the present embodiment, and the broken line represents characteristics when the wall height is 6.0 mm. FIG. 6B is a diagram illustrating a section of the antenna device 10 for a vehicle illustrated in FIG. 3, the diagram being provided to explain the wall height.

When attention is focused around directions of ±90 degrees orthogonal to the line connecting the center of the radiating element 31 and feeding point 31*h* out of the plate directions of the radiating element 31, it can be seen that when the wall heights are such that the walls project above the radiating element 31, gain characteristics are improved greatly. However, it can be seen that there is no significant difference in gain characteristics between the wall height of 3.5 mm and wall height of 6.0 mm.

<Modifications>

Whereas an example of embodiments to which the present invention is applied has been described above, the configurations to which the invention is applicable are not limited to the above embodiment, and components can be added, omitted, or changed as appropriate.

First Example of Modifications

Figure 7:
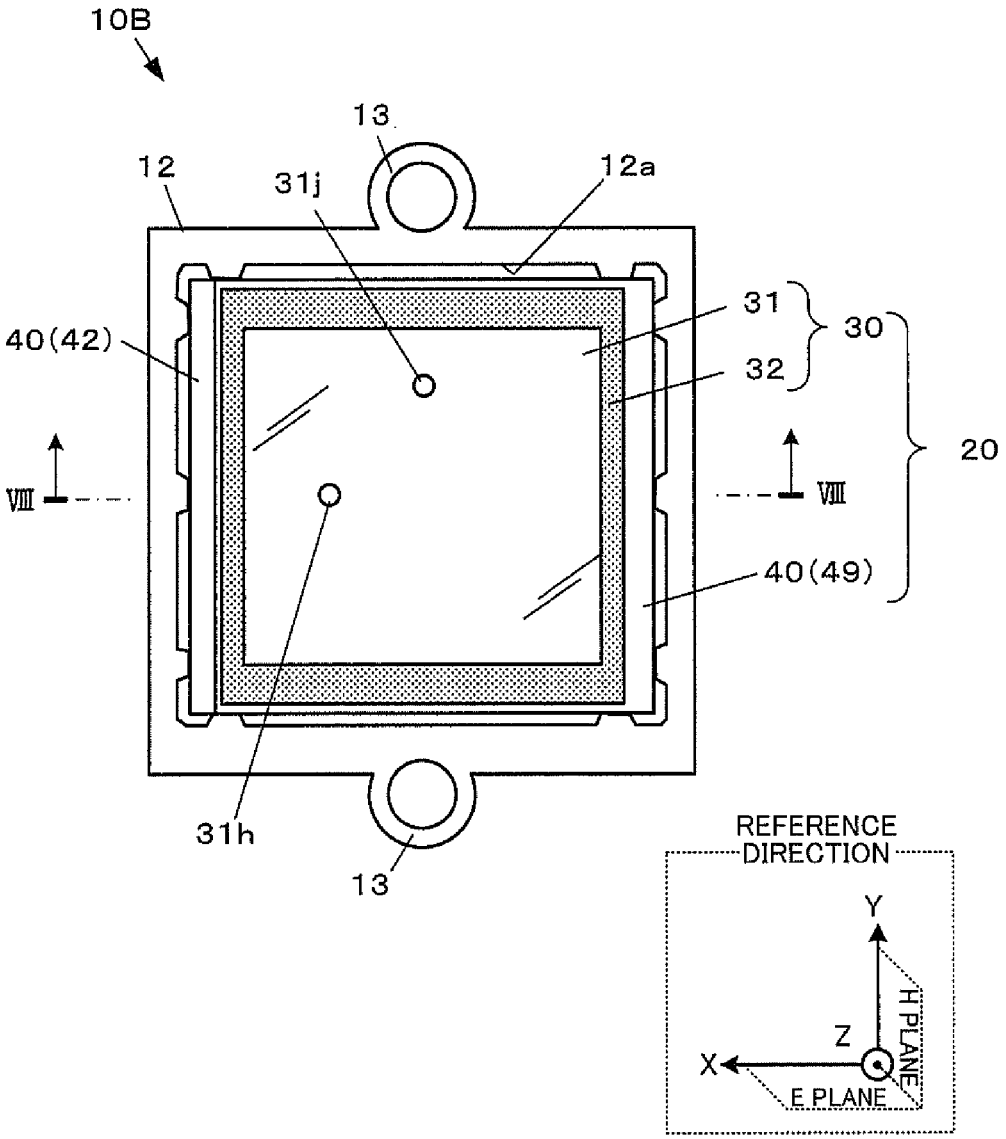
FIG. 7 is a diagram illustrating an example of modifications in which one metal wall is provided outside a peripheral edge of a radiating element.
Figure 8:
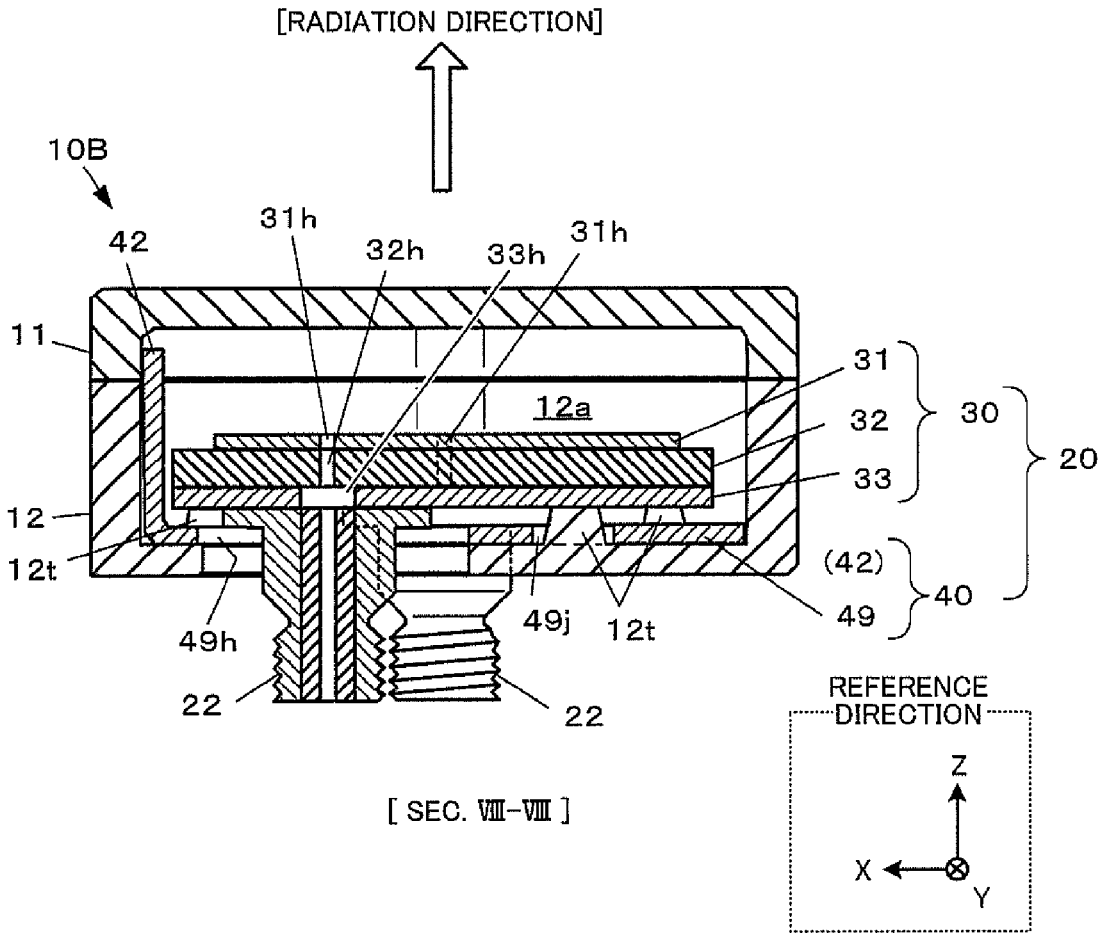
FIG. 8 is a longitudinal sectional view of the antenna device for a vehicle according to the example of the modifications taken along line VIII-VIII in FIG. 7.

For example, in the above embodiment, the metal walls of the metal part 40 are provided on either side of the radiating element 31 outside the peripheral edges of the antenna main body 30, i.e., outside the peripheral edges of the radiating element 31 such that the wall surfaces will intersect the line connecting the center of the radiating element 31 and feeding point 31*h*. However, as illustrated in FIGS. 7 and 8, an antenna device 10B for a vehicle is configured to have a metal wall only on one side. FIG. 7 is a diagram illustrating an internal configuration example of the antenna device 10B for a vehicle, in which one metal wall is provided outside a peripheral edge of the radiating element 31. FIG. 8 is a longitudinal sectional view of the antenna device 10B for a vehicle including the first housing 11, taken along line VIII-VIII in FIG. 7. In the example of FIGS. 7 and 8, the second metal wall 42 is left by omitting the first metal wall 41, but the first metal wall 41 may be left by omitting the second metal wall 42. Although the antenna device 10B for a vehicle is illustrated in FIGS. 7 and 8 as an example of a circularly polarized antenna according to a second example of modifications described later, the circularly polarized antenna having two feeding points, the antenna device 10B may include a linearly polarized antenna equipped with only one feeding point 31*h* as with the above embodiment. Even if the antenna device has a configuration in which a metal wall is provided only on one side in this way, out of the plate directions of the radiating element 31, gain in the direction intersecting the line connecting the center of the radiating element 31 and feeding point 31*h* can be improved.

Second Example of Modifications

Figure 9:
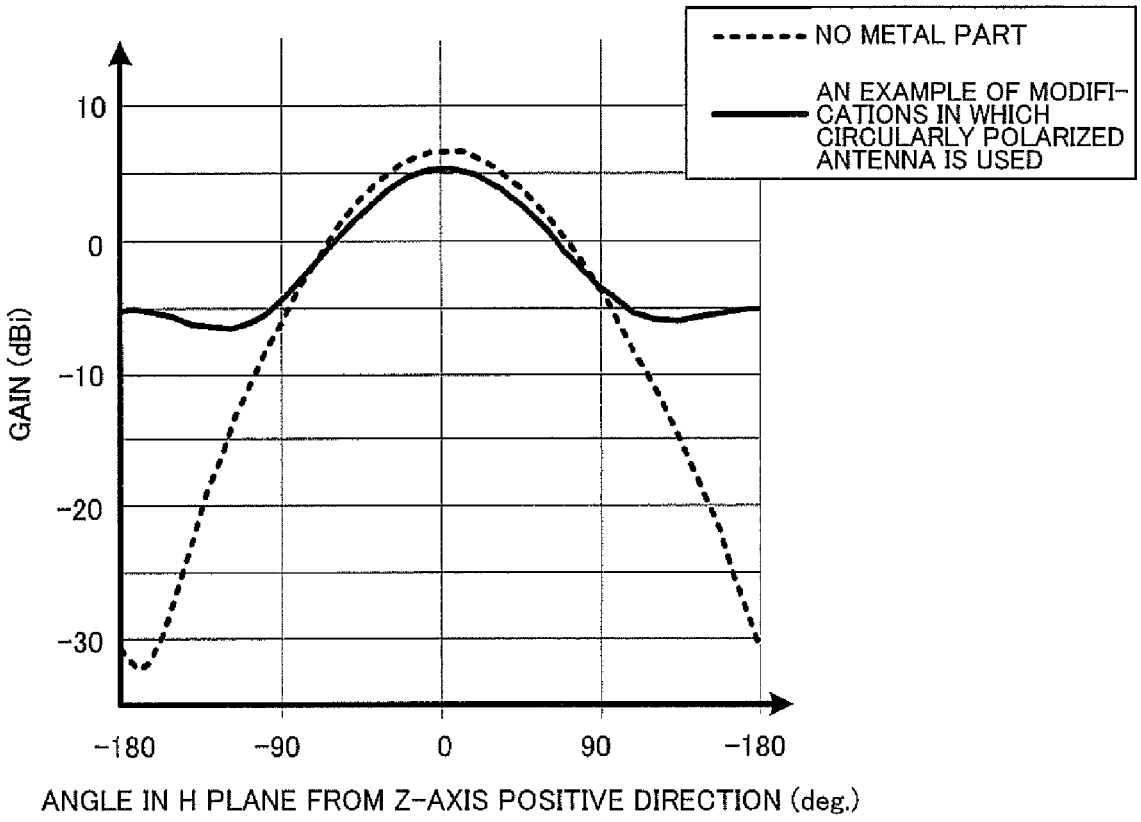
FIG. 9 is a graph of gain characteristics of the antenna device for a vehicle having a circularly polarized antenna.

Also, whereas in the above embodiment, the patch antenna 20 is a linearly polarized antenna, as illustrated in FIGS. 7 and 8, the antenna device 10B for a vehicle may be a circularly polarized antenna provided with a feeding point 31*j* in addition to the feeding point 31*h*. FIG. 9 is a graph of gain characteristics of the antenna device for a vehicle having a circularly polarized antenna, the curve being obtained in the H plane (plane in Y-Z directions). As with FIG. 5, the illustrated antenna gain is obtained when the Z-axis positive direction in the H plane is 0 degrees and the Z-axis negative direction is −180 degrees. The +90-degree direction and −90-degree direction correspond to the Y-axis directions. The solid line in FIG. 9 is obtained when the first metal wall 41 and second metal wall 42 are provided as with the above embodiment. As illustrated in FIG. 9, even when the patch antenna is a circularly polarized antenna, it can be seen that gain can be improved around directions of ±90 degrees orthogonal to the line connecting the center of the radiating element 31 and feeding point 31*h* out of the plate directions of the radiating element 31.

Third Example of Modifications

Also, in the above embodiment, metal walls are provided on either side of the radiating element 31 out of four sides surrounding the radiating element 31 outside the peripheral edges of the radiating element 31. Also, an example of modifications in which a metal wall is provided on one side rather than two opposite sides has been described as the first example of modifications. However, metal walls may be provided on all four sides surrounding the radiating element 31 or provided in an L-shaped arrangement on two adjacent ones of the four sides.

Figure 10:
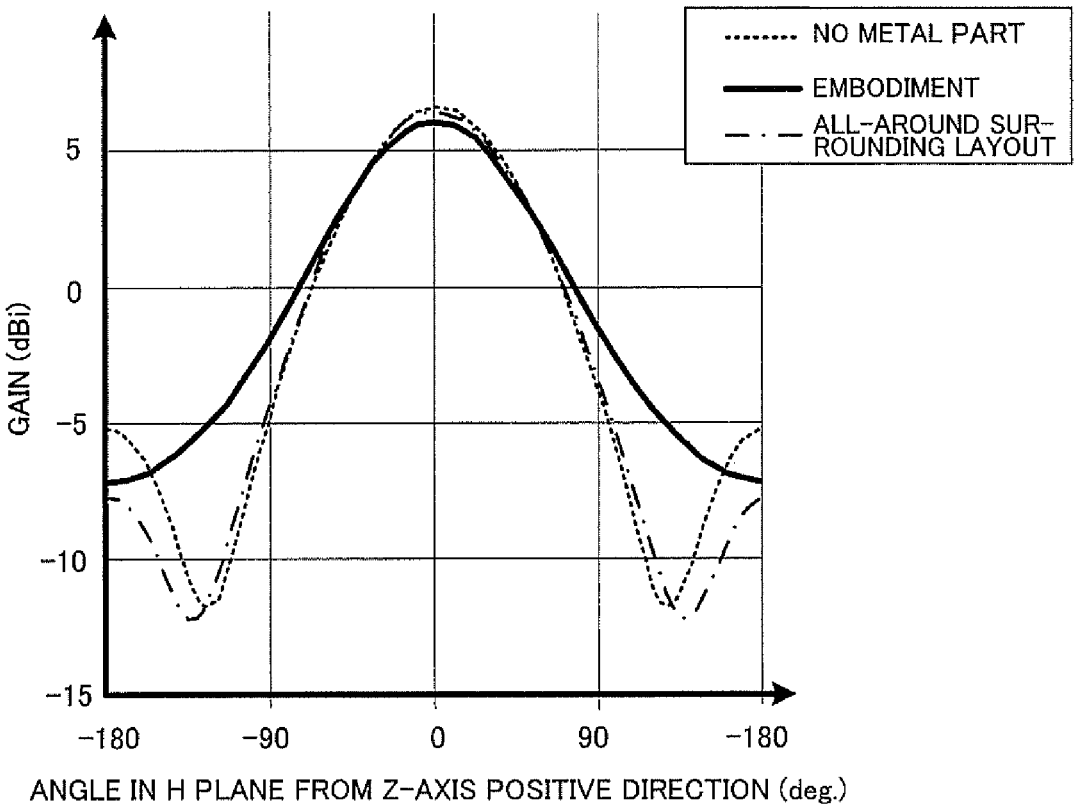
FIG. 10 is a graph of gain characteristics obtained when the metal walls are arranged to surround all around.

FIG. 10 is a gain characteristic curve obtained in the H plane (plane in Y-Z directions) when an all-around surrounding layout is used in which metal walls are provided on all the four sides surrounding the radiating element 31. As with FIG. 5, the illustrated antenna gain is obtained when the Z-axis positive direction in the H plane is 0 degrees and the Z-axis negative direction is −180 degrees. The +90-degree direction and −90-degree direction correspond to the Y-axis directions. In FIG. 10, for comparison purposes, characteristics according to the above embodiment (configuration in which metal walls are provided on either side of the radiating element 31) are represented by a solid line, characteristics of a comparative configuration (conventional configuration) in which metal walls are omitted are represented by a dotted line, and characteristics of the all-around surrounding layout are represented by a dash-and-dot line. Also, values of gain at ±90 degrees are shown in a table.

As illustrated in FIG. 10, when compared to the comparative configuration (conventional configuration) in which metal walls are omitted, it can be seen that the all-around surrounding layout can also improve gain around directions of ±90 degrees orthogonal to the line connecting the center of the radiating element 31 and feeding point 31*h* out of the plate directions of the radiating element 31.

Figure 11:
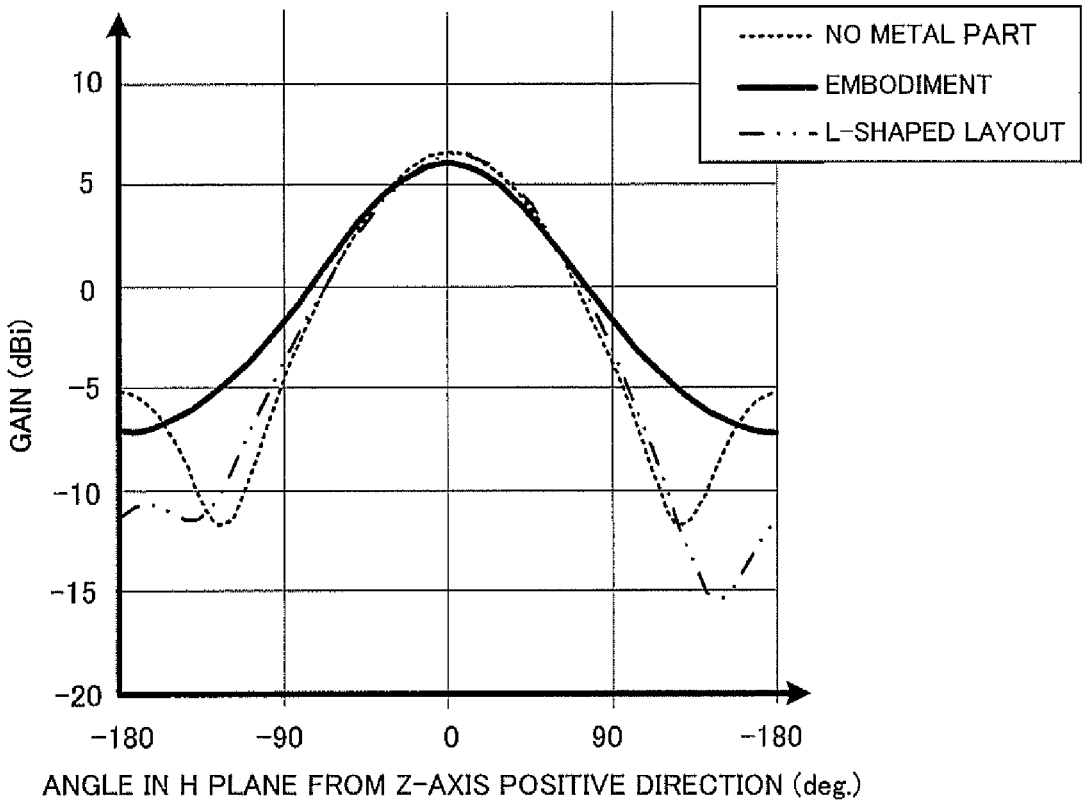
FIG. 11 is a graph of gain characteristics obtained when the metal walls are arranged to form an L-shaped layout.

FIG. 11 is a graph of gain characteristics obtained in the H plane (plane in Y-Z directions) when an L-shaped layout is used in which metal walls are provided in an L-shaped arrangement on two adjacent ones of the four sides surrounding the radiating element 31. As with FIG. 5, the illustrated antenna gain is obtained when the Z-axis positive direction in the H plane is 0 degrees and the Z-axis negative direction is −180 degrees. The +90-degree direction and −90-degree direction correspond to the Y-axis directions. In FIG. 11, for comparison purposes, characteristics according to the above embodiment (configuration in which metal walls are provided on either side of the radiating element 31) are represented by a solid line, characteristics of a comparative configuration (conventional configuration) in which metal walls are omitted are represented by a dotted line, and characteristics of the L-shaped layout are represented by a dash-and-double dot line. Also, values of gain at ±90 degrees are shown in a table.

As illustrated in FIG. 11, when compared to the comparative configuration (conventional configuration) in which metal walls are omitted, it can be seen that the L-shaped layout can also improve gain around directions of ±90 degrees orthogonal to the line connecting the center of the radiating element 31 and feeding point 31*h* out of the plate directions of the radiating element 31.

Fourth Example of Modifications

Figure 12:
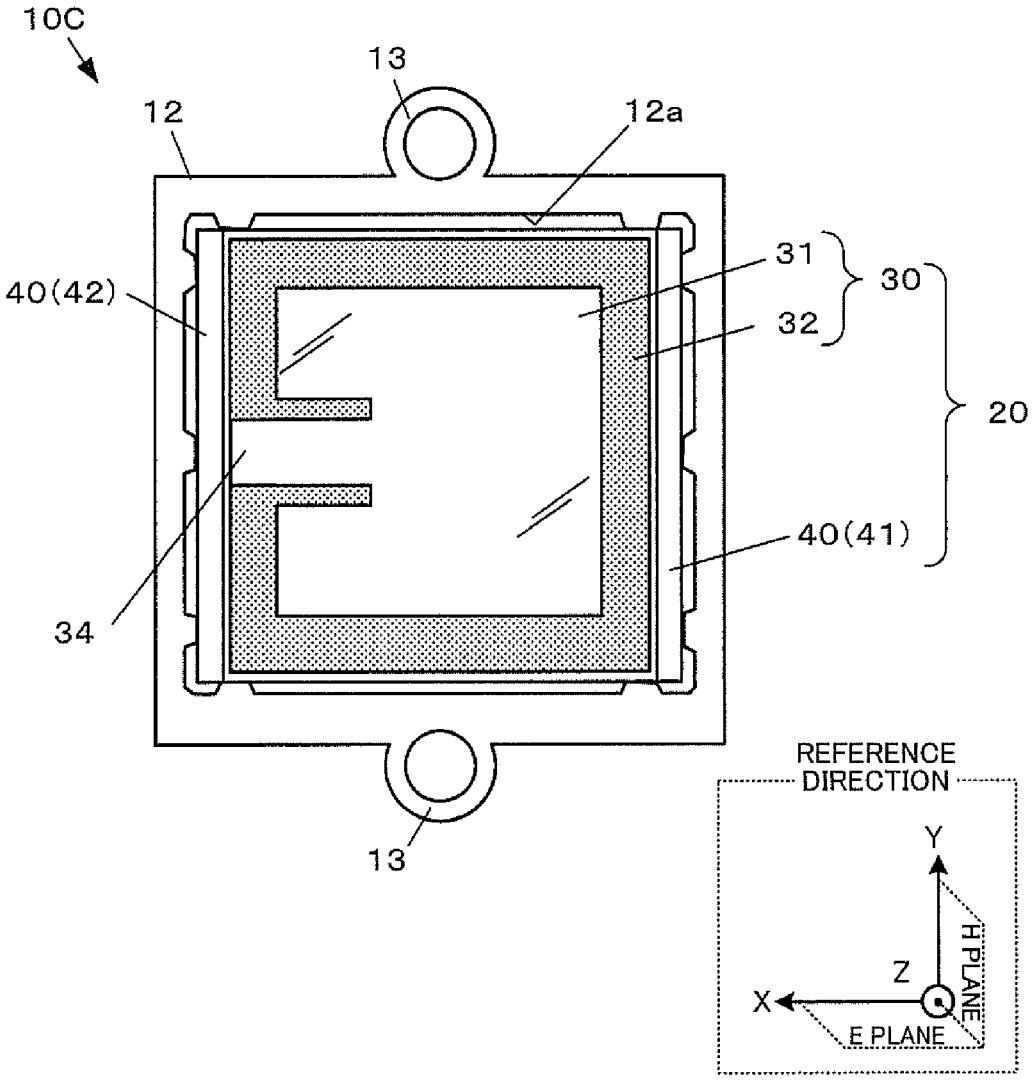
FIG. 12 is a diagram illustrating an example of modifications in which the antenna is configured as a coplanar feed type.

Also, whereas in the above embodiment, a power feeding scheme of the radiating element 31 is back-side coaxial feeding, an antenna device 10C for a vehicle may be configured as a coplanar feeding form by providing a microstrip line 34 as illustrated in FIG. 12.

Fifth Example of Modifications

Figure 13:
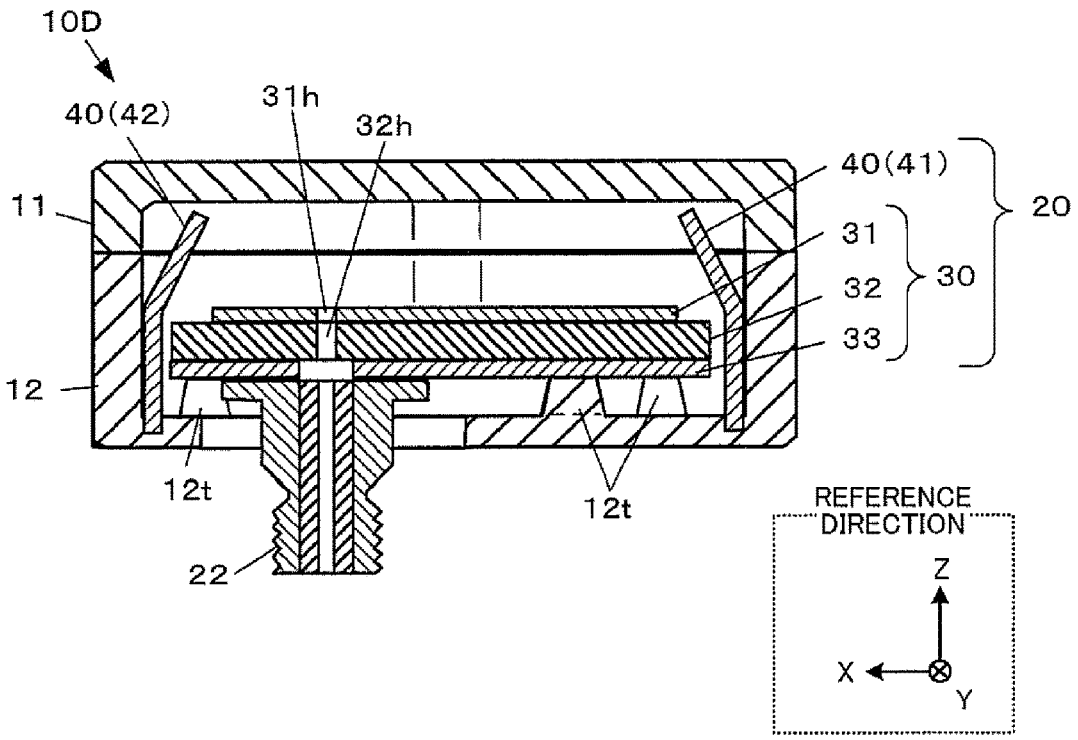
FIG. 13 is a diagram illustrating an example of modifications in which a first metal wall and a second metal wall are configured as mutually independent sheet metal parts by omitting a base.

Also, whereas a configuration of the metal part 40 has been shown in the above embodiment, in which the first metal wall 41, base 49, and second metal wall 42 are integrated by bending one end portion and the other end portion of a metal sheet and thereby forming a bent shape, an antenna device 10D for a vehicle may be implemented, in which the first metal wall 41 and second metal wall 42 are configured as independent metal parts by omitting the base 49 as illustrated in FIG. 13.

Sixth Example of Modifications

Figure 14:
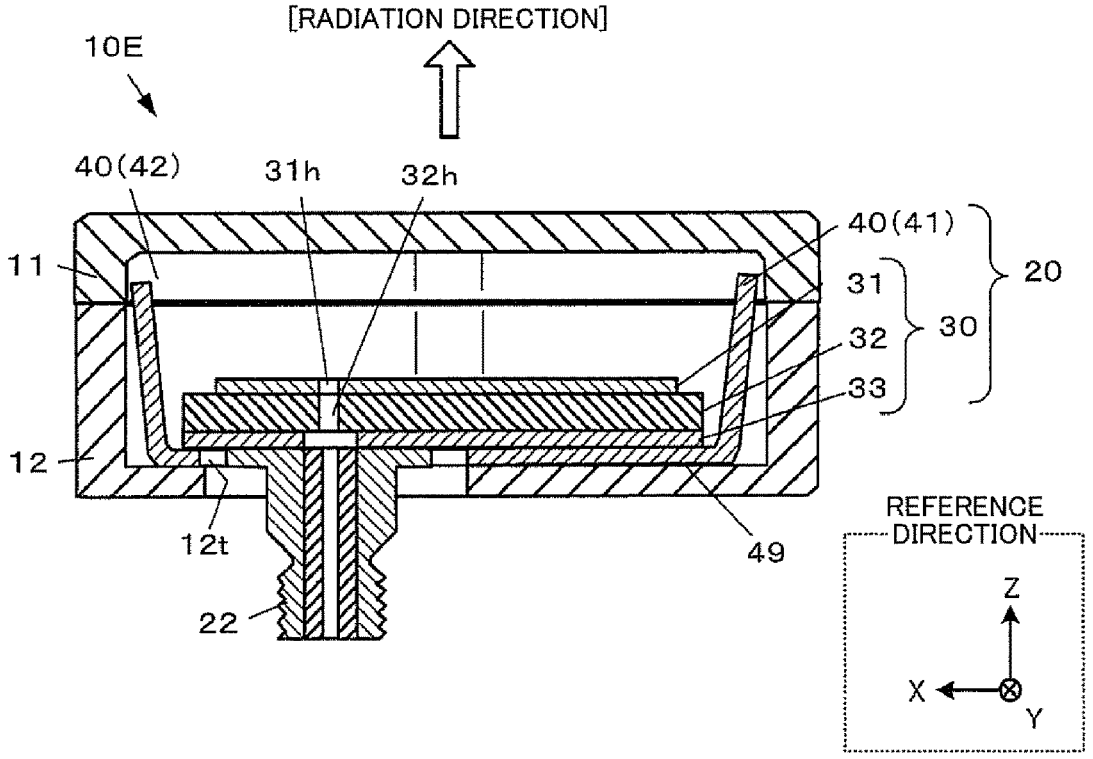
FIG. 14 is a diagram illustrating an example of modifications in which a ground plate and a metal part are electrically continuous with each other.

Also, whereas the above embodiment has been illustrated by example as having a configuration in which the ground plate 33 and metal part 40 are electrically isolated from each other, an antenna device 10E for a vehicle may be implemented, in which the ground plate 33 and metal part 40 are placed in contact with each other for electrical conduction as illustrated in FIG. 14. Alternatively, the ground plate 33 and metal part 40 may be integrated.

Seventh Example of Modifications

Also, whereas in the above embodiment, the first metal wall 41 and second metal wall 42 are configured to be parallel or substantially parallel to the Z-axis direction, the wall surfaces of the first metal wall 41 and second metal wall 42 do not necessarily have to be parallel. For example, the first metal wall 41 and second metal wall 42 may assume such an inclined attitude that their tip portions will come closer to the center of the antenna main body 30 as illustrated in FIG. 13 or go away from the antenna main body 30 as illustrated in FIG. 14. As long as the gain in the direction intersecting the line connecting the center of the radiating element 31 and feeding point 31*h* out of the plate directions of the radiating element 31 is improved, the first metal wall 41 and second metal wall 42 may be inclined at any angle.

EXPLANATION OF REFERENCES

10, 10B, 10C, 10D, 10E Antenna device for a vehicle
11 First housing
12 Second housing
13 Support
20 Patch antenna
22 Coaxial substrate connector
30 Antenna main body
31 Radiating element
31*h* Feeding point (core wire attachment hole)
32 Dielectric substrate
33 Ground plate
40 Metal part
41 First metal wall
42 Second metal wall
49 Base

The invention claimed is:

1. An antenna device for a vehicle comprising:

a patch antenna comprising an antenna main body and a metal part;

wherein the antenna main body includes a dielectric body sandwiched between a planar radiating element and a ground plate, said radiating element having a square shape and disposed above the ground plate; and wherein the metal part includes a first metal wall provided outside a first peripheral edge of the radiating element, and a second metal wall symmetrical to the first metal wall provided outside a second peripheral edge of the radiating element, such that wall surfaces of the metal walls intersect a line connecting a center of the radiating element and a feeding point, the metal walls extending in a radiation direction of the radiating element;

wherein the antenna main body and the metal part are electrically isolated from each other;

wherein a coaxial connector, for coupling to a coaxial cable providing the feeding point, is mounted on an undersurface of the ground plate through an insertion hole, the connector being electrically isolated from the metal part; and wherein the patch antenna is disposed in a rectangular case having a block construction divided into a first housing and a second housing in the radiation direction, and the insertion hole is provided in the second housing.

2. The antenna device for a vehicle according to claim 1, wherein the metal walls are installed by being electrically isolated from the ground plate.

3. The antenna device for a vehicle according to claim 2, further comprising:

the metal part composed of a base and the metal walls formed by a bent-shaped metal; and the ground plate installed by being spaced away from the base.

4. The antenna device for a vehicle according to claim 3, wherein:

the metal part has a bent shape formed by the base located in a central portion thereof and the metal walls are respectively located on one side and another side of the base.

5. The antenna device for a vehicle according to claim 1, wherein the metal walls are respectively formed as a thin metal film.

6. The antenna device for a vehicle according to claim 1 wherein the case is installed in a predetermined orientation at a predetermined position of the vehicle; and wherein the case includes a support for supporting the patch antenna such that the patch antenna is directed so as to perform at least receiving vertically polarized waves when the case is installed in the predetermined orientation at the predetermined position.

7. The antenna device for a vehicle antenna according to claim 2, wherein the metal walls are respectively formed as a thin metal film.

8. The antenna device for a vehicle according to claim 4, wherein the case is installed in a predetermined orientation at a predetermined position of the vehicle; and wherein the case includes a support for supporting the patch antenna such that the patch antenna is directed so as to perform at least receiving vertically polarized waves when the case is installed in the predetermined orientation at the predetermined position.

9. The antenna device for a vehicle according to claim 1, wherein the case defines an accommodation space accommodating the antenna main body and the metal walls, wherein the metal walls are disposed between the antenna main body and the case, and wherein the case includes a protrusion which protrudes from a bottom face to the accommodation space and on which the antenna main body is mounted.

10. An antenna device for a vehicle, the antenna device comprising:

a patch antenna including a flat-plate radiating element, and a metal wall provided outside a peripheral edge of the radiating element, such that a wall surface of the metal wall intersects a line connecting a center of the radiating element and a feeding point;

a housing installed in a predetermined orientation at a predetermined position of the vehicle; and a support for supporting the patch antenna such that the patch antenna is used for directed so as to perform at least receiving vertically polarized waves when the housing is installed in the predetermined orientation at the predetermined position, wherein the patch antenna includes a metal part composed of a base and the metal wall formed by a bent-shaped metal, and an antenna main body having the radiating element and a ground plate, where the ground plate is installed by being spaced away from the base and thereby electrically isolated from the metal part, the metal wall is placed on either side of the radiating element, protrudes forward of the radiating element in a radiation direction, is installed by being electrically isolated from the ground plate, and the metal part has a bent shape formed by the base located in a central portion thereof and the metal wall located on one side and another side of the base.

11. The antenna device for the vehicle according to claim 10, wherein the housing defines an accommodation space accommodating the antenna main body and the metal wall, and the housing includes a protrusion which protrudes from a bottom face to the accommodation space and on which the antenna main body is mounted.

* * * * *